US008186337B2

(12) United States Patent
Nadel

(10) Patent No.: US 8,186,337 B2
(45) Date of Patent: May 29, 2012

(54) TOY GUN ASSEMBLY

(76) Inventor: Craig P. Nadel, Montville, NJ (US)

( * ) Notice: Subject to any disclaimer, the term of this patent is extended or adjusted under 35 U.S.C. 154(b) by 0 days.

(21) Appl. No.: 12/685,963

(22) Filed: Jan. 12, 2010

(65) Prior Publication Data

US 2011/0168149 A1 Jul. 14, 2011

(51) Int. Cl.
*F41B 11/00* (2006.01)

(52) U.S. Cl. ..... 124/63; 42/54; 446/473

(58) Field of Classification Search ..... 124/59–61, 124/63–69, 2, 16, 17, 18, 19, 21; 222/79; 42/54, 55, 57; 446/405, 406, 407, 473; D21/573, D21/574, 575

See application file for complete search history.

(56) References Cited

U.S. PATENT DOCUMENTS

| | | | | | |
|---|---|---|---|---|---|
| 573,353 | A * | 12/1896 | Potts | 89/9 |
| 2,752,825 | A * | 7/1956 | Crigger et al. | 89/37.01 |
| 3,507,067 | A * | 4/1970 | Into | 42/10 |
| 3,641,691 | A * | 2/1972 | Ellis et al. | 42/105 |
| 3,999,533 | A * | 12/1976 | Buckner | 124/69 |
| 4,603,497 | A * | 8/1986 | Crimmins, Jr. | 42/106 |
| 4,689,911 | A * | 9/1987 | White | 42/105 |
| 4,733,489 | A * | 3/1988 | Kurak | 42/77 |
| 5,198,600 | A * | 3/1993 | E'Nama | 42/90 |
| 5,617,837 | A * | 4/1997 | Momirov | 124/73 |
| 5,794,606 | A * | 8/1998 | Deak | 124/51.1 |
| 5,797,385 | A * | 8/1998 | Thai | 124/66 |
| 5,819,715 | A * | 10/1998 | Haneda et al. | 124/6 |
| 6,067,975 | A * | 5/2000 | Ginn | 124/59 |
| 6,481,145 | B2 * | 11/2002 | Weichert et al. | 42/105 |
| 6,829,858 | B2 * | 12/2004 | Gablowski | 42/105 |
| 7,000,345 | B1 * | 2/2006 | Kay | 42/75.02 |
| 7,267,118 | B2 * | 9/2007 | Eddins et al. | 124/63 |
| 7,798,364 | B1 * | 9/2010 | Eddins et al. | 222/79 |
| 2001/0042334 | A1 * | 11/2001 | Weichert et al. | 42/105 |
| 2004/0025395 | A1 * | 2/2004 | Gablowski | 42/105 |
| 2005/0183708 | A1 * | 8/2005 | Eddins et al. | 124/59 |
| 2006/0026885 | A1 * | 2/2006 | Tony | 42/105 |
| 2008/0022990 | A1 * | 1/2008 | Mitchell | 124/65 |
| 2010/0307472 | A1 * | 12/2010 | Witzigreuter | 124/69 |

* cited by examiner

*Primary Examiner* — Troy Chambers
(74) *Attorney, Agent, or Firm* — Raymond R. Ferrera; Adams and Reese LLP

(57) ABSTRACT

A toy gun assembly has at least two, first and second independently operable toy guns. Each of those guns has a body and a shooting mechanism in the body. The toy guns are connectable with each other by means of a connector. The shooting mechanisms of the toy guns are independently operable when the toy guns are connected by the connector.

9 Claims, 16 Drawing Sheets

TOY GUN ASSEMBLY

The present invention relates to a toy gun assembly. More particularly, although not exclusively, the invention relates to a separable toy gun assembly.

BACKGROUND OF THE INVENTION

For many years, toy guns have been popular with children of various ages. Over time many efforts have been made to develop improved toy guns that better capture and hold the attention of children. Through this process, more sophisticated toys have been developed.

A variety of toy gun devices have been described in the prior art. These includes play guns with sounds and light effect, water guns, projectile guns which launch harmless soft foam projectiles by a blast of air, and guns with multiple projectile-shooting air guns.

Guns of different types are for different purposes. Children will have to carry a number if toy guns so that they may switch between different types of guns in a "gun battle". Children can easily lose one of the guns if they are not careful.

To avoid losing the guns, children are usually allowed to carry only one gun. Thus, if two children wish to play and only one child has a gun, little fun can be had.

OBJECT OF THE INVENTION

It is an object of the present invention to overcome or substantially ameliorate at least one of the above disadvantages and/or more generally to provide a separable toy gun assembly.

SUMMARY OF THE INVENTION

There is disclosed herein according to the invention, a toy gun assembly comprising at least two, first and second independently operable toy guns, each having a body and a shooting mechanism in the body; wherein the toy guns are connectable with each other by means of a connector, the shooting mechanisms remaining independently operable when the toy guns are connected by the connector.

Preferably, the connector comprises a first connecting component of the first toy gun inter-engageable with a second connecting component of the second toy gun, the first connecting component being movable between a first position in engagement with the second connecting component and a second position out of engagement with the second connecting component, and a resilient biasing element resiliently biasing the first connecting component towards the first position to engage with the second connecting component.

More preferably, the first connecting component is associated with a release member which is arranged, upon movement, to move the first connecting component against the action of the resilient biasing member so as to disengage from the second connecting component.

Further more preferably, the connector comprises a latch.

Yet further more preferably, the toy gun assembly includes a third toy gun having a body and a shooting mechanism in the body, and a second connector for connecting the third toy gun with the first toy gun, and a coupler adapted to couple the second toy gun with the third toy gun.

It is preferred that, the coupler comprises a first coupling component of the second toy gun inter-engageable with a second coupling component of the third toy gun, the first coupling component being the second connecting component and inter-engageable with the first connecting component for connecting the second toy gun with the first toy gun.

It is further preferred that the toy guns have respective shooting axes and are inter-engageable together with their shooting axes extending in the same direction.

Yet further more preferably, the shooting mechanism of at least one of the toy guns is driven by an air pump.

It is further preferred that, said at least one of the toy guns comprises a projectile gun and includes a reciprocating member arranged for reciprocating motion relative to the body for charging air into the air pump.

More preferably, the shooting mechanism of at least one of the toy guns comprises a pair of rollers driven by an electric motor to rotate in opposite directions for ejecting a projectile passing through the rollers.

BRIEF DESCRIPTION OF THE DRAWINGS

The invention will now be more particularly described, by way of example only, with reference to the accompanying drawings, in which.

DETAILED DESCRIPTION OF PREFERRED EMBODIMENTS

Figure 1:
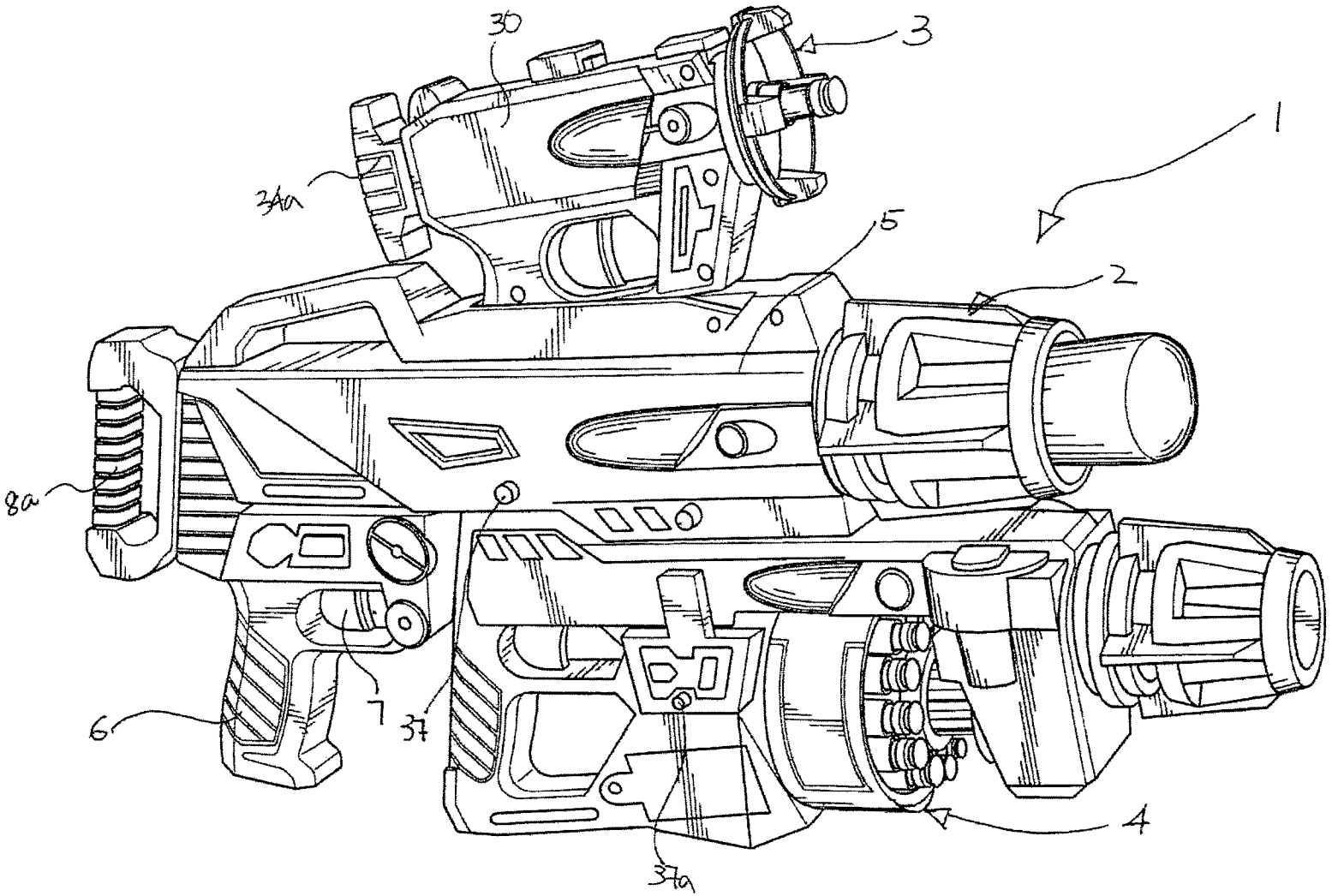
FIG. 1 is a perspective view of an embodiment of a toy gun assembly in accordance with the invention including an upper gun and a lower gun connected to a primary gun.
Figure 2:
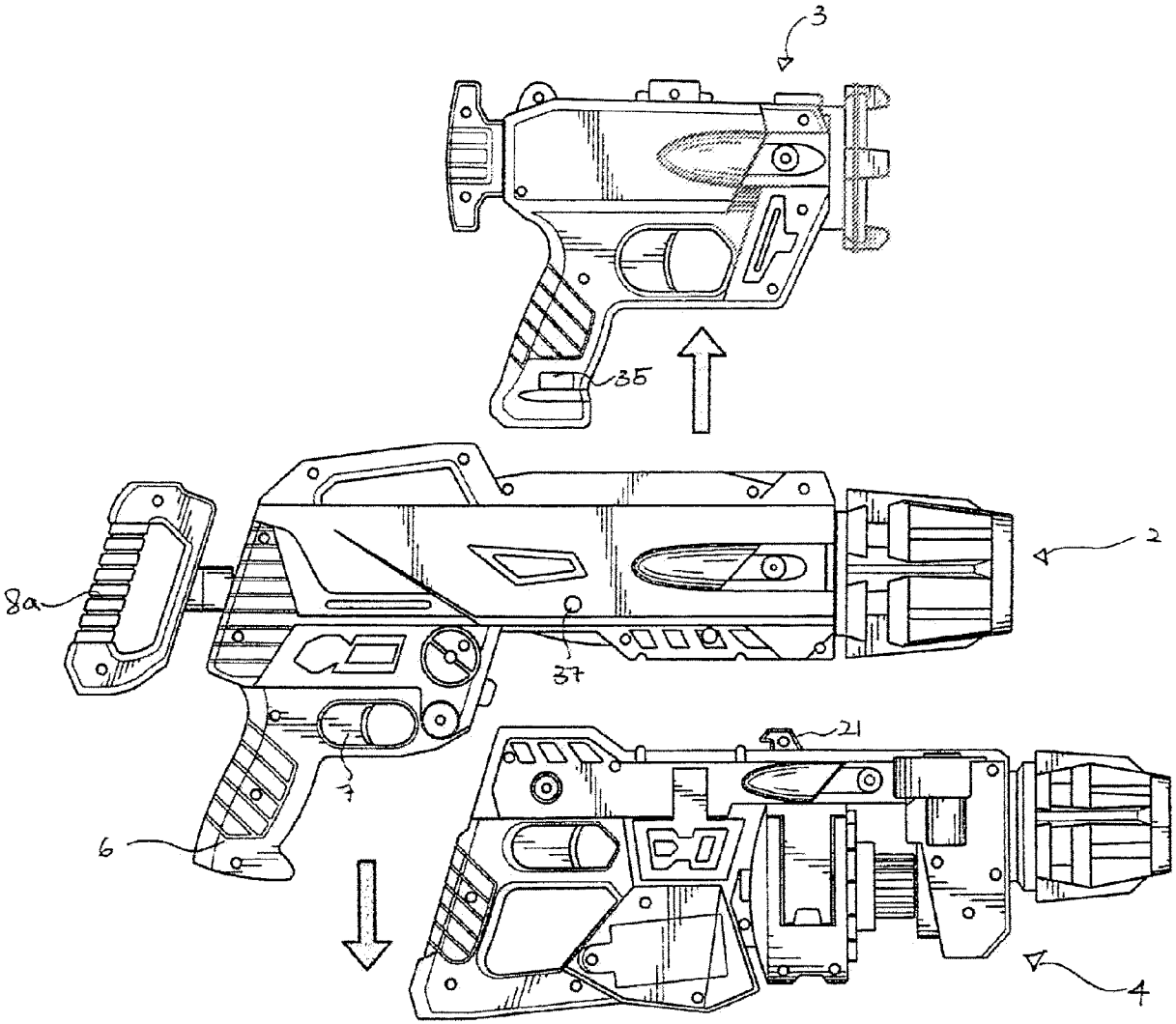
FIG. 2 is a side view of the toy gun assembly of FIG. 1 showing the upper and the lower gun being separated from the primary gun.
Figure 6:
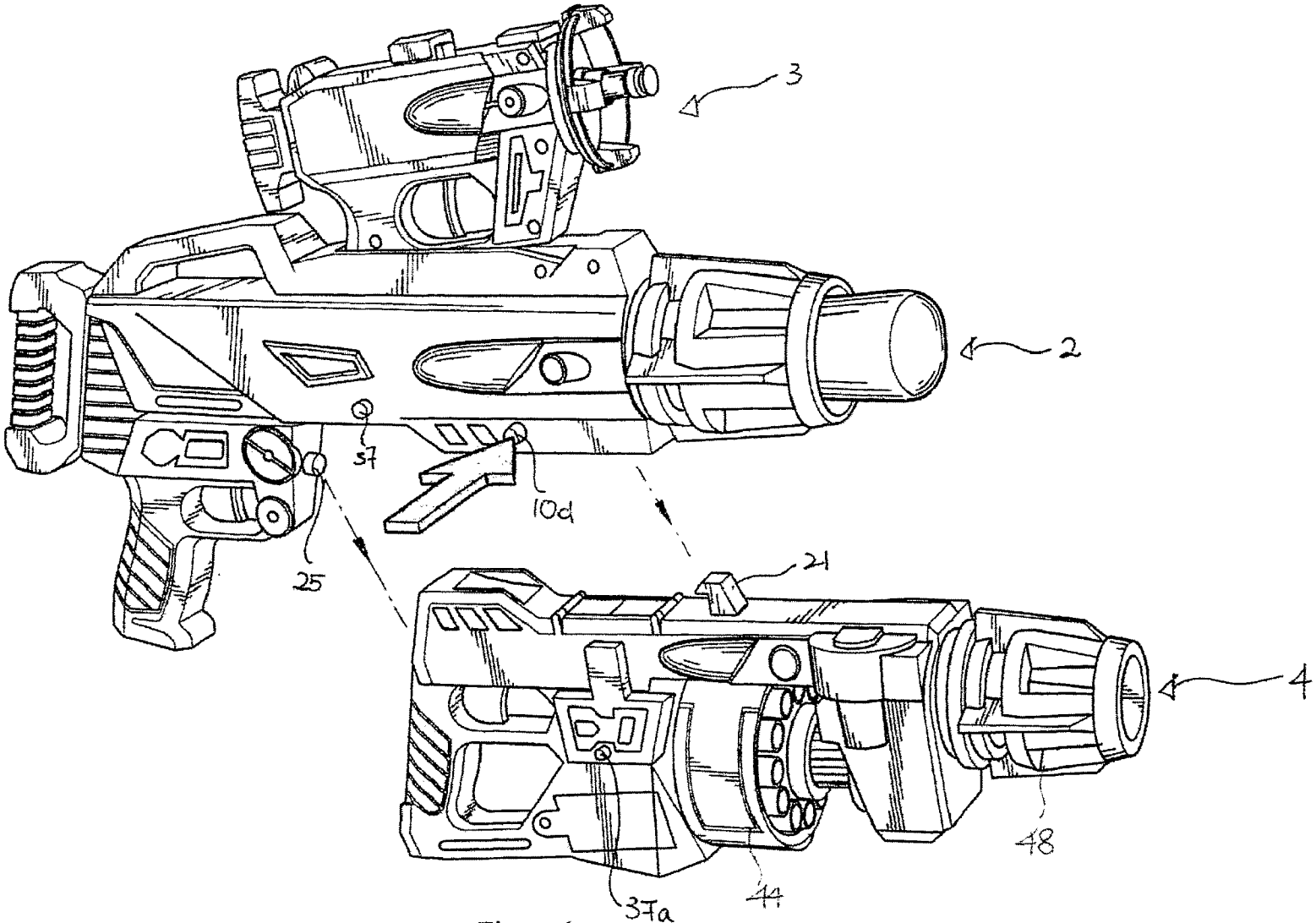
FIG. 6 is a perspective view of the toy gun assembly of FIG. 1 showing the lower gun being detached.

Referring to FIGS. 1, 2 and 6, there is shown a three-in-one toy gun assembly 1 embodying the invention, which includes three guns, a primary gun 2, an upper gun 3 and a lower gun 4. These guns 2, 3, 4 are separably connectable with one another via connector and coupling to form the three-in-one toy gun assembly 1.

Figure 3:
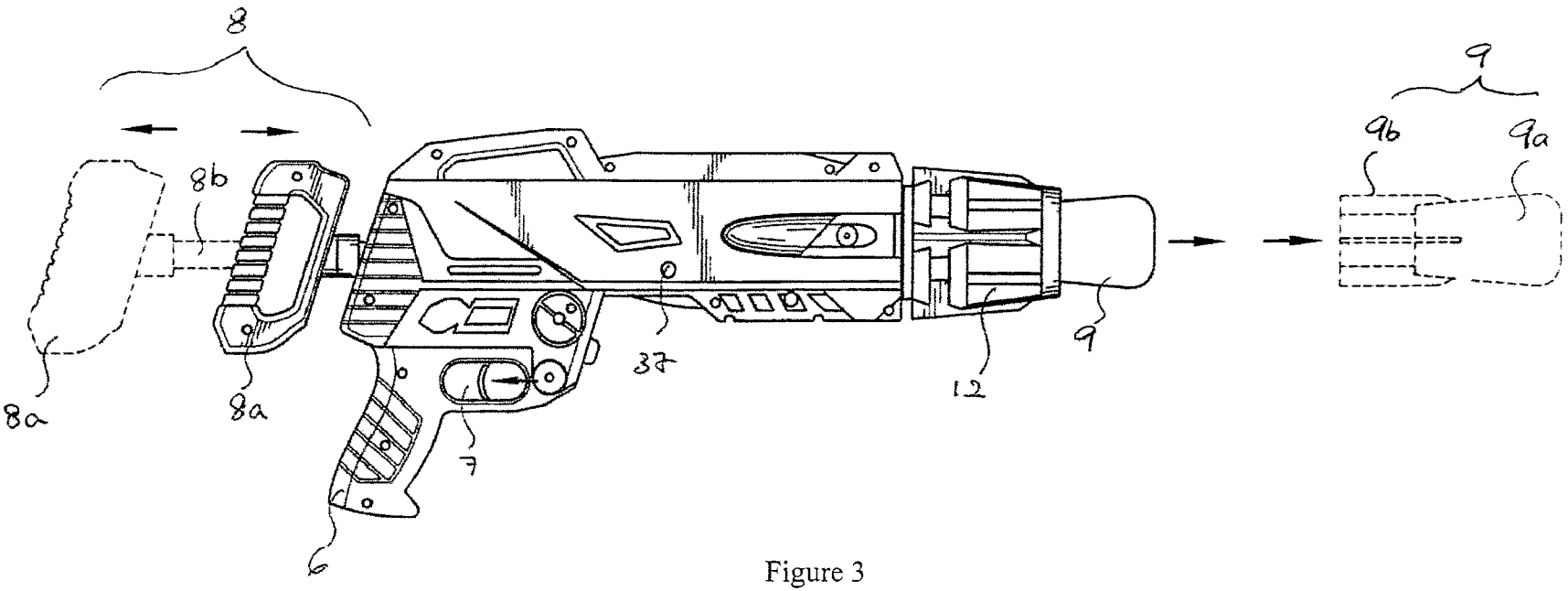
FIG. 3 is a side view of the primary gun as shown in FIG. 1.

The primary gun 2, as shown in FIG. 3, is an air gun. It has a body 5, a gun handle 6 that provides a grip to facilitate holding and firing the gun and a trigger 7 for firing the gun 2 when actuated.

The gun 2 is adapted to fire harmless projectiles with a blast of air. To this end, the body 5 contains an internal air chamber (not shown) guarded by valves. One of these valves assists the building up of air pressure inside the chamber by preventing the air from leaving the chamber. The other is openable by the user to release the retained air.

For the purpose of developing a force sufficient to expel a projectile from the gun 2, the gun 2 is provided with means for forcing air into the air chamber to build up the pressure within the air chamber. The means is an air pump. The air pump includes a piston 8 that runs through a rear opening of the body 5 into the body 5 adjacent an opening of the air chamber. The piston 8 includes a piston handle 8*a* at one end of a piston shaft 8*b*. The piston 8 is capable of reciprocating movement in and out of the rear opening. By moving the piston 8 reciprocally, air is pump into an internal air chamber (not shown) inside the body 5.

A preferred projectile 9 is shown in FIG. 3. The projectile 9 preferably comprises a bulbous head 9*a* and end fins 9*b* made of rubber or the like.

In order to position the projectile in the path of the air forced from the air chamber, the toy gun is provided with a magazine (not shown) having one launch tube 12. The magazine is fixedly mounted at distal end of the body 5. The launch tube 12 is sized and shaped to receive the fins 9*b* of the projectile 9. When the toy gun 2 is fired, air forced from the air chamber enters the launch tube 12 to expel the projectile 9.

The toy gun 2 is connectable to the toy gun 4. Toy gun 4, as shown in FIG. 4, is an electric multiple projectile shooting gun. The gun 4 has a body 41, a handle 42, a trigger 43, a barrel 44 and a pair of rollers 50*a*, 50*b*.

A projectile 45, in this case a soft foam dart, has a suction cup 45*a* and a cylindrical body 45*b* adapted to fit over launch tube 48. Launch tube 48 has an outlet 48*a* at its forward end for launching. Launch tube 48 is a formed part of rotating magazine, which is mounted on barrel 44. After a user has loaded projectiles onto the magazine and has the trigger 43 actuated, it causes the projectile 45 to be expelled out of the launch tube 48 into the barrel 44. Inside the barrel 44 there is a pair of rollers 50*a*, 50*b* caused to rotate electrically. The projectile 45 is fed through the rollers 50*a*, 50*b* which are driven by an electric motor to rotate in opposite directions for ejecting the projectile 45 passing there through, this allow the projectile 45 to gain speed before leaving the gun 4.

Figure 4A:
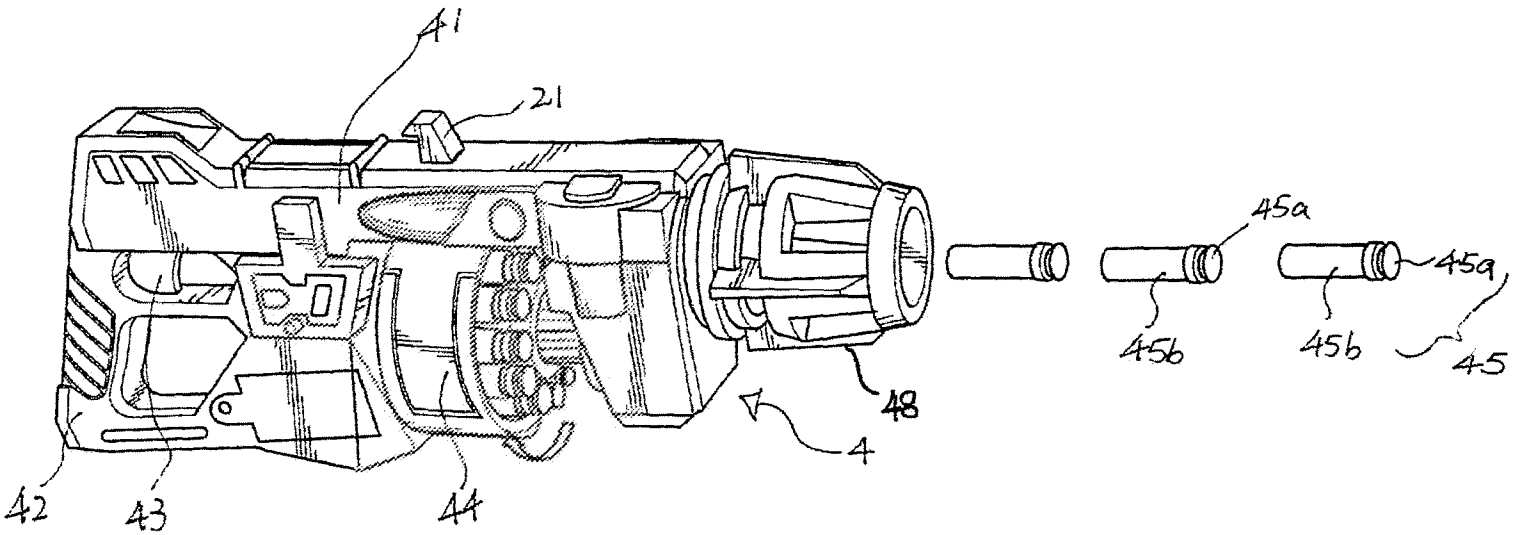
FIG. 4*a* is a perspective view of the lower gun in FIG. 1.
Figure 4B:
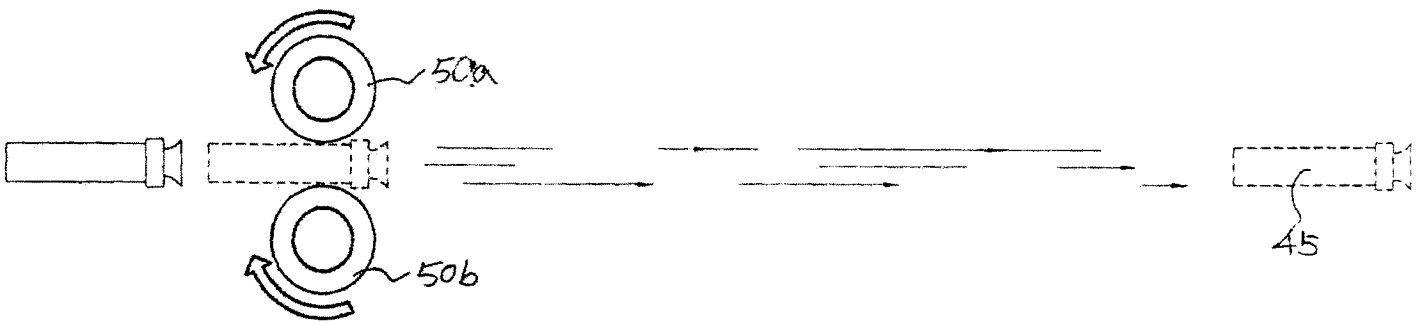
FIG. 4*b* is a schematic illustration of a projectile passing through a pair of rollers of the lower gun as shown in FIG. 4*a;*

By pulling the trigger 43, the magazine is caused to rotate in a clockwise direction as shown in FIG. 4*a*, the launch tube with the projectile being fired is moved away from the launch position. A subsequent launch tube is moved to the launch position with the launched projectile ready for fire.

Figure 5A:
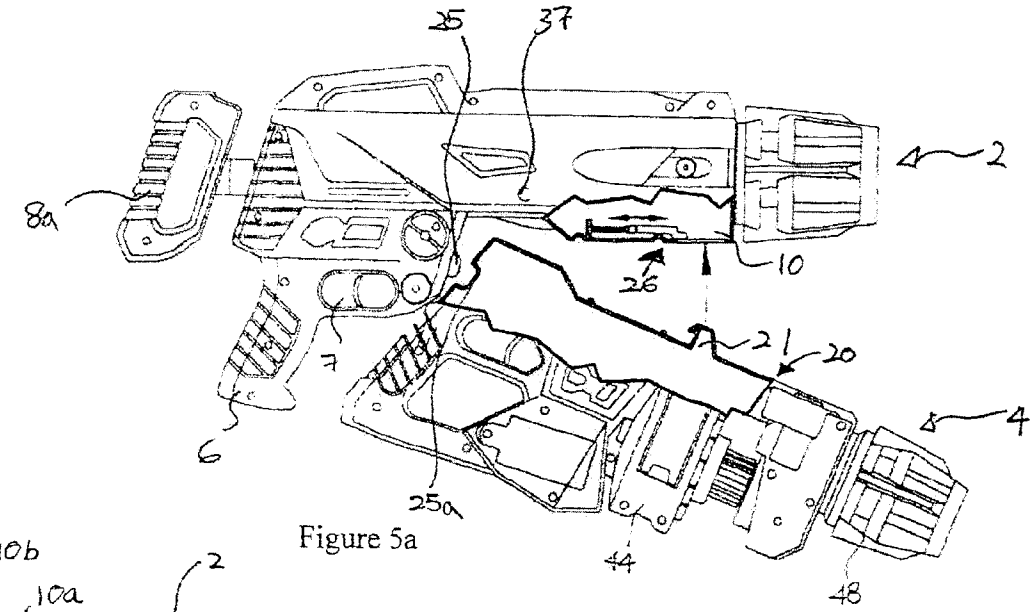
FIG. 5*a* is a side view of the primary gun and the lower gun of FIG. 1.
Figure 5C:
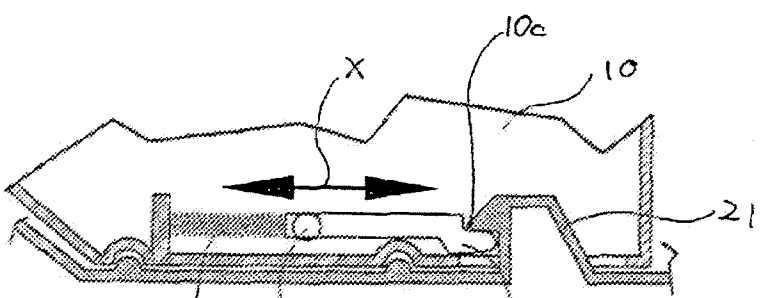
FIG. 5*c* is an enlarged view of the connector of FIG. 5*b;*
Figure 5B:
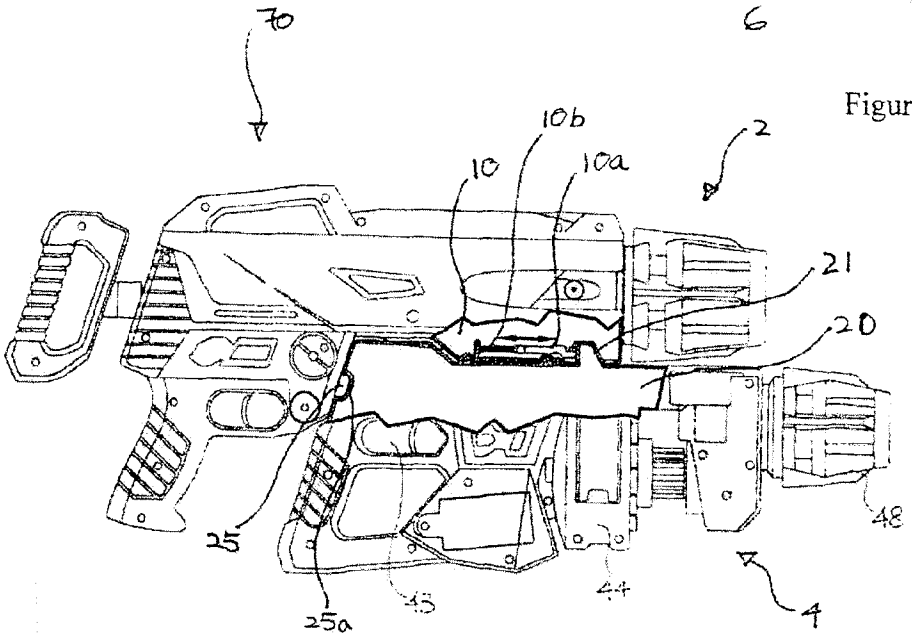
FIG. 5*b* is a side view of a further embodiment of a toy gun assembly in accordance with the invention including the primary gun and the lower gun of FIG. 5*a* being connected by a connector.

As shown in FIGS. 5*a* and 5*b*, toy gun 2 is connected with toy gun 4 by a connector to form a 2-in-1 gun assembly 70. The connector is a latch with a female component 10 and a male component 21.

In accordance with a preferred embodiment of the invention as shown in FIG. 3, the body 5 has an opening (not shown) on its underside 26. The female component 10 is provided inside the body 5, close to the opening. The female component 10 includes a slidable tongue 10*a* and a resilient biasing means i.e. a spring 10*b*. The tongue 10*a* is capable of reciprocating motion along axis X relative to the body 5 between a first position away from the launching tube 12 and second position towards the launching tube 12. The spring 10*b* is provided at one end of the tongue 10*a* and bias against movement of a tongue 10*a* towards the first position.

The male component 21 is a hook-like projection rigidly extending upward from top of the body 20 of the gun 4.

To connect guns 2 and 4, the hook 21 is inserted into the opening on the body 5 of gun 2. The spring 10*b* urges the tongue 10*a* towards the second position to engage the hook 21. The flange of the hook 21 rests on a recess 10*c* of the tongue 10*a*.

Referring to FIGS. 5*a* and 5*b*, when guns 2 and 4 are connected, a projection 25 of gun 2 is fitted into a complementary recess 25*a* on the rear of gun 4 to reinforce the connection between guns 2 and 4.

In order to disengage gun 4, the female component 10 has an operating button 10*d*. The button 10*d* when pressed forces the tongue 10*a* to move towards the first position against the spring 10*b*. This releases the hook 21 and gun 4.

Figure 7:
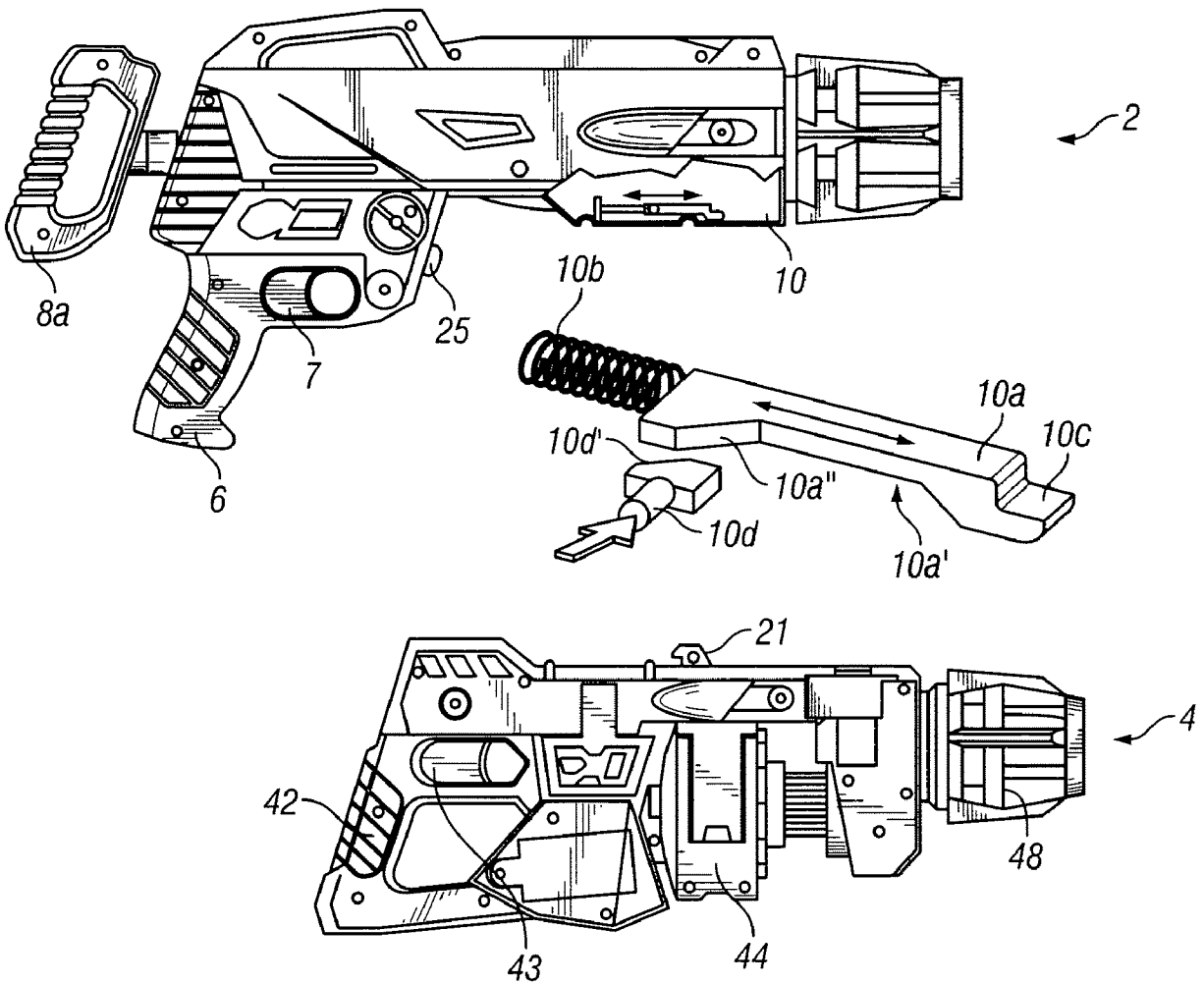
FIG. 7 is a side view of the primary gun and the lower gun of FIGS. 5*b* and 6 with an enlarged top perspective view of a female component of the connector of FIG. 5*b;*

Referring to FIG. 7, the button 10*d* has an enlarged trapezoidal end 10*d*. The trapezoidal end 10*d* has a slanted side 10*d*'. The tongue 10*a* has a complementary trapezoidal recess 10*a*' with a slanted inner wall 10*a*". The trapezoidal end 10*d* is partly inserted into the recess 10*a*'. When the button 10*d* is pushed, the trapezoidal end 10*d* moves further into the recess 10*a*'. The slanted side 10*d*' of the button 10*d* slide against the slanted inner wall 10*a*" of the recess 10*a*'. The tongue 10*a* is forced to move towards the first position against spring 10*b*, releasing the hook 21 to disengage gun 4 from gun 2 as shown in FIG. 6.

Figure 8:
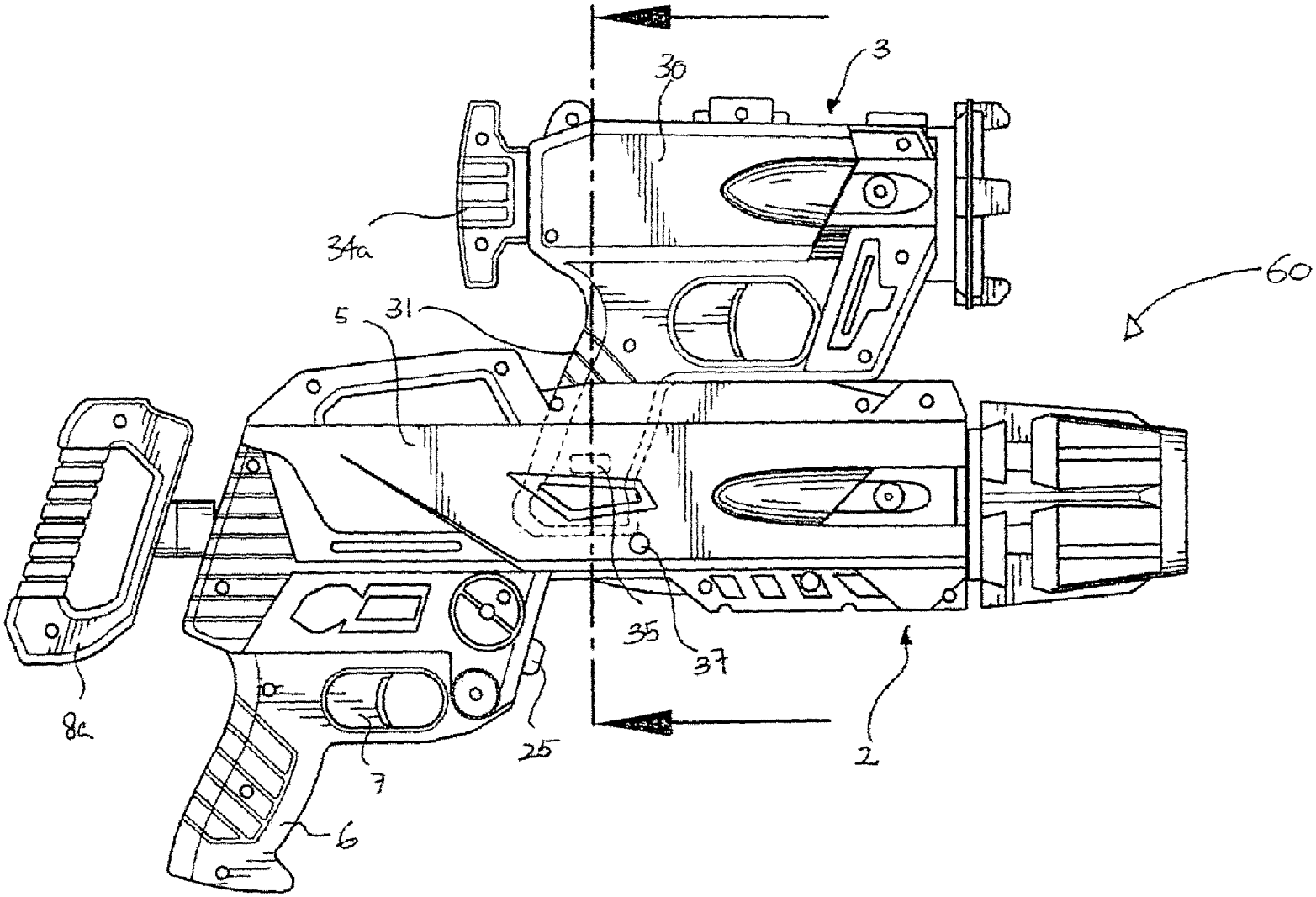
FIG. 8 is a side view of an alternative embodiment of a toy gun assembly in accordance with the invention including the upper gun and the primary gun of FIG. 1.
Figure 9:
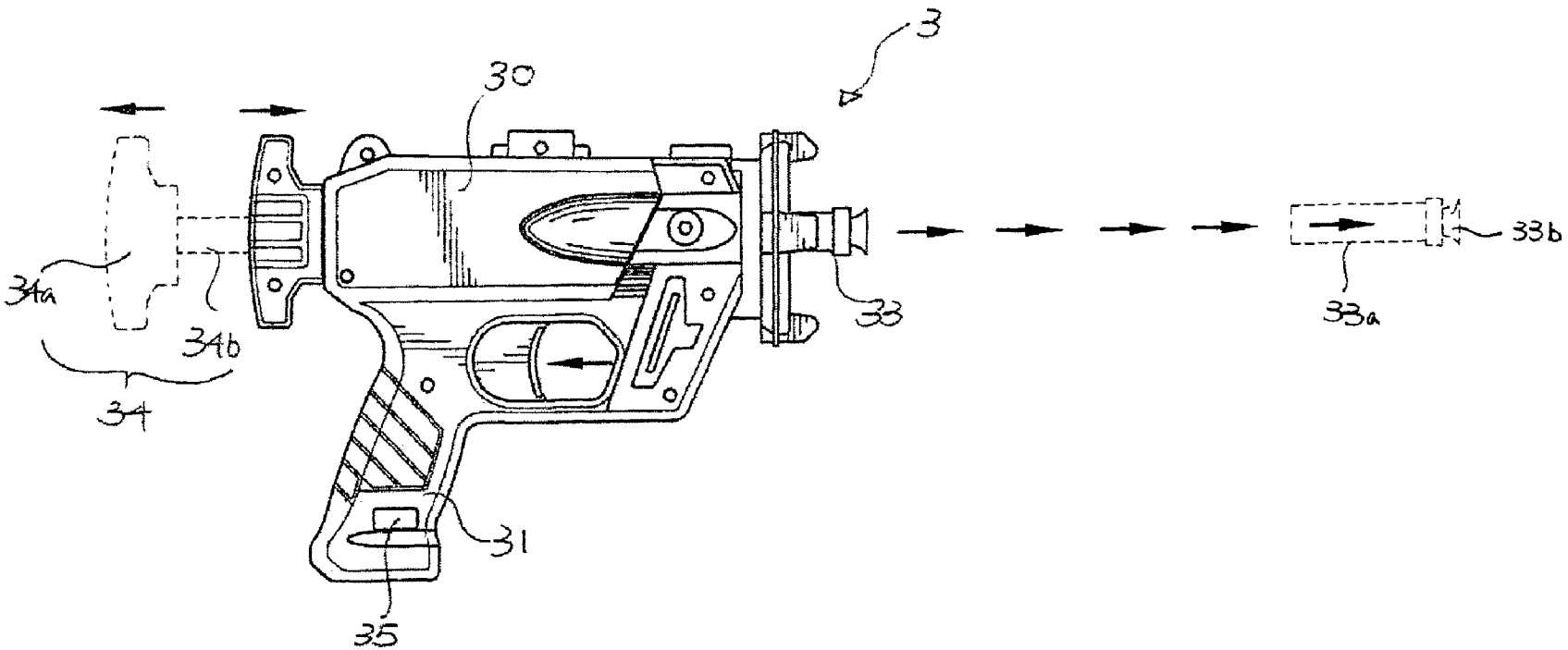
FIG. 9 is a side view of the upper gun of FIG. 8.

Toy gun 2 is also connectable with toy gun 3 with or without toy gun 4, as shown in FIG. 8. Referring now to FIG. 9, toy gun 3 is also an air gun but of a much smaller scale as compared to toy gun 2. Toy gun 3 has a body 30, a gun handle 31 that provides a grip to facilitate holding and firing the gun and a trigger 32 for firing the gun when actuated.

To develop a force sufficient to expel a projectile from the gun 3, the gun 3 has an air pump includes a piston 34 running through a rear opening of the body 30. The piston 34 has a piston handle 34*a* at one end and a shaft 34*b*. Just like the piston 8 of gun 2, the piston 34 is capable of reciprocating movement in and out of the rear opening. By pulling the piston 8 away from the gun 3, air is sucked into and stored in the body 30. When the trigger 32 is actuated, the stored air is released to form a blast of air expelling the projectile.

A preferred projectile 33 is shown in FIG. 9. The projectile 33 preferably comprises a cylindrical body 33*a* and a pliable cup 33*b* made of rubber or the like.

In order to position the projectile 33 in the path of the air forced from the air chamber, the toy gun 3 is provided with a magazine (not shown) having one launch tube (not shown). The magazine is fixedly mounted at distal end of the body 30. The launch tube is sized to receive a projectile. When the toy gun 3 is fired, air forced from the air chamber enters the launch tube to expel the projectile 33.

A connector is provided for connecting gun 2 and gun 3. The connector includes male 36 and female components 35. The female component 35 is a recess on the handle 31 of gun 3. The male component is a hook 36 provided inside the body 5 of gun 2, adjacent an opening on top of the body 5. The opening is sized to receive the handle 31. The opening is guarded by a pair of pivotable doors 32 which can be easily pushed open.

Figure 10A:
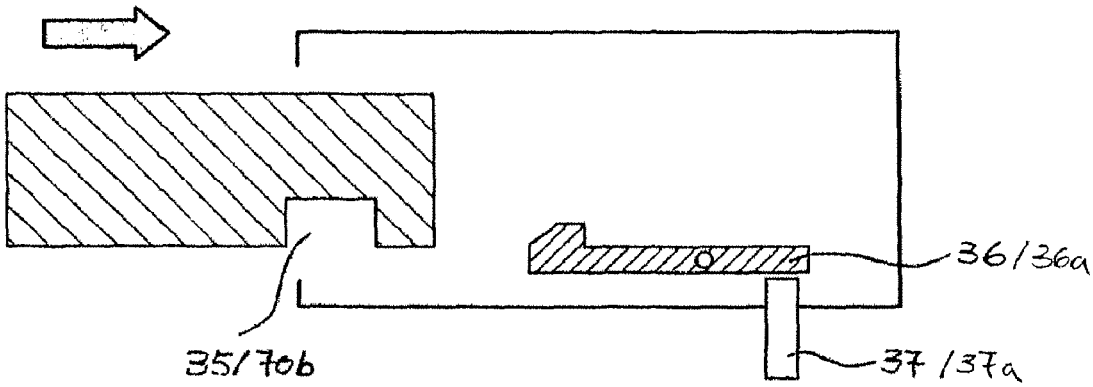
FIG. 10*a* is a schematic illustration of a connector or a coupling connecting the upper gun and the primary gun of FIG. 1 or the upper and the primary gun of FIG. 8.
Figure 10B:
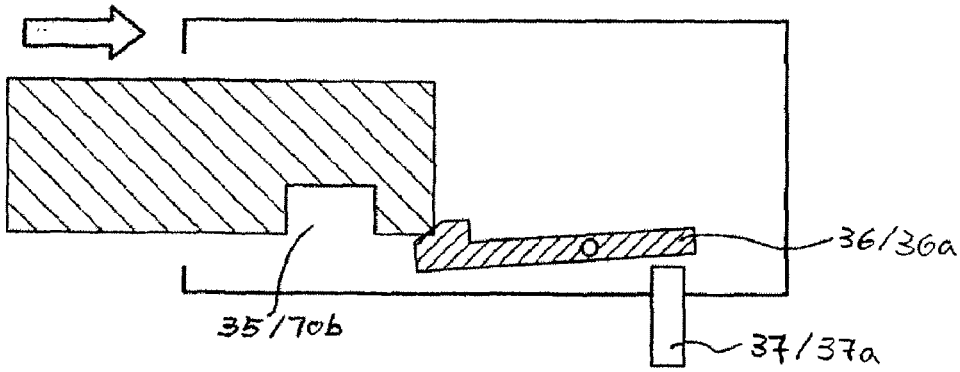
FIG. 10*b* is a schematic illustration of a female and male component of the connector or coupling of FIG. 10*a* with the female component being moved in a direction for engagement with the male component.
Figure 10C:
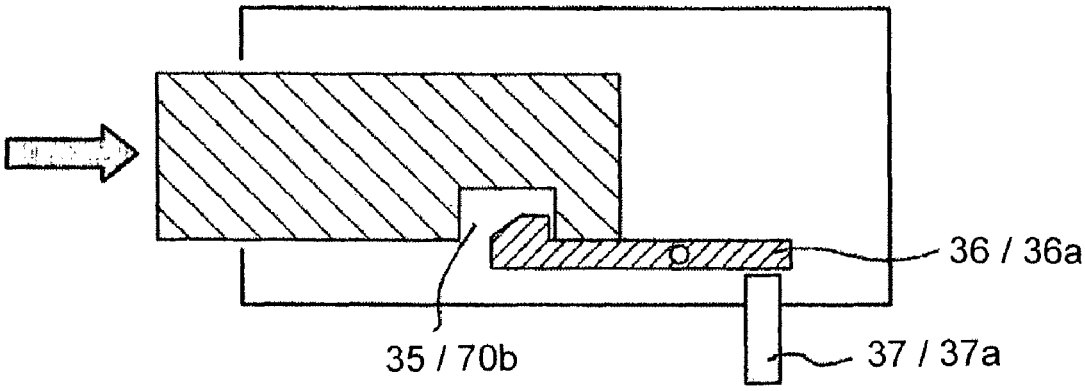
FIG. 10*c* is a schematic illustration of the female and male component of FIG. 10*b* being connected.

As shown in FIGS. 10*a* to 10*c*, when the handle 31 is inserted into the body 5 through the opening, the hook 36 is hooked onto the recess 35. A biasing means (not shown) biases against movement of the hook 36 away from the recess 35, thereby locking the hook 36 to the recess 35.

Figure 10D:
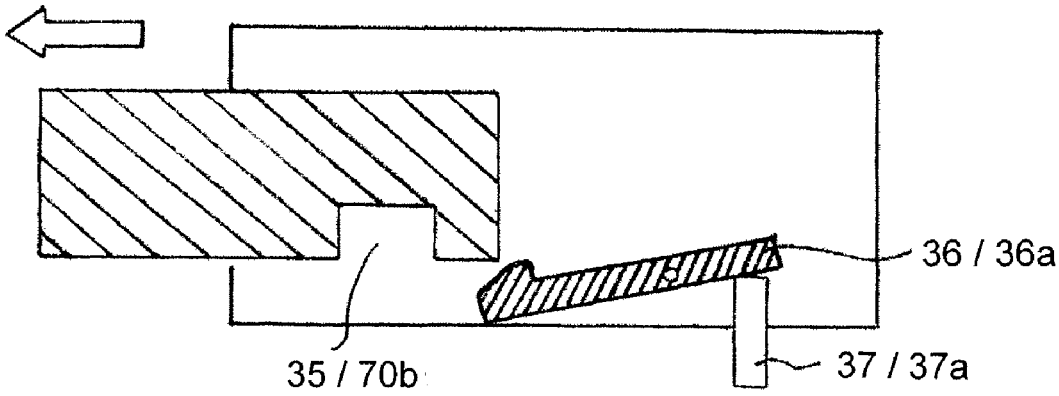
FIG. 10*d* is a schematic illustration of the male and female component of FIG. 10*c* showing the female component being moved in a direction for disengaging with the male component.

The hook 36 can be released by pressing a release member, which is a button 37, as shown in FIG. 10*d*. The hook 36 has a long handle 36*a* and the button 37 engages rear end of the long handle 36*a*. By pressing the button 37, the hook 36 is caused to bias against the biasing means to release the recess 35.

Figure 11:
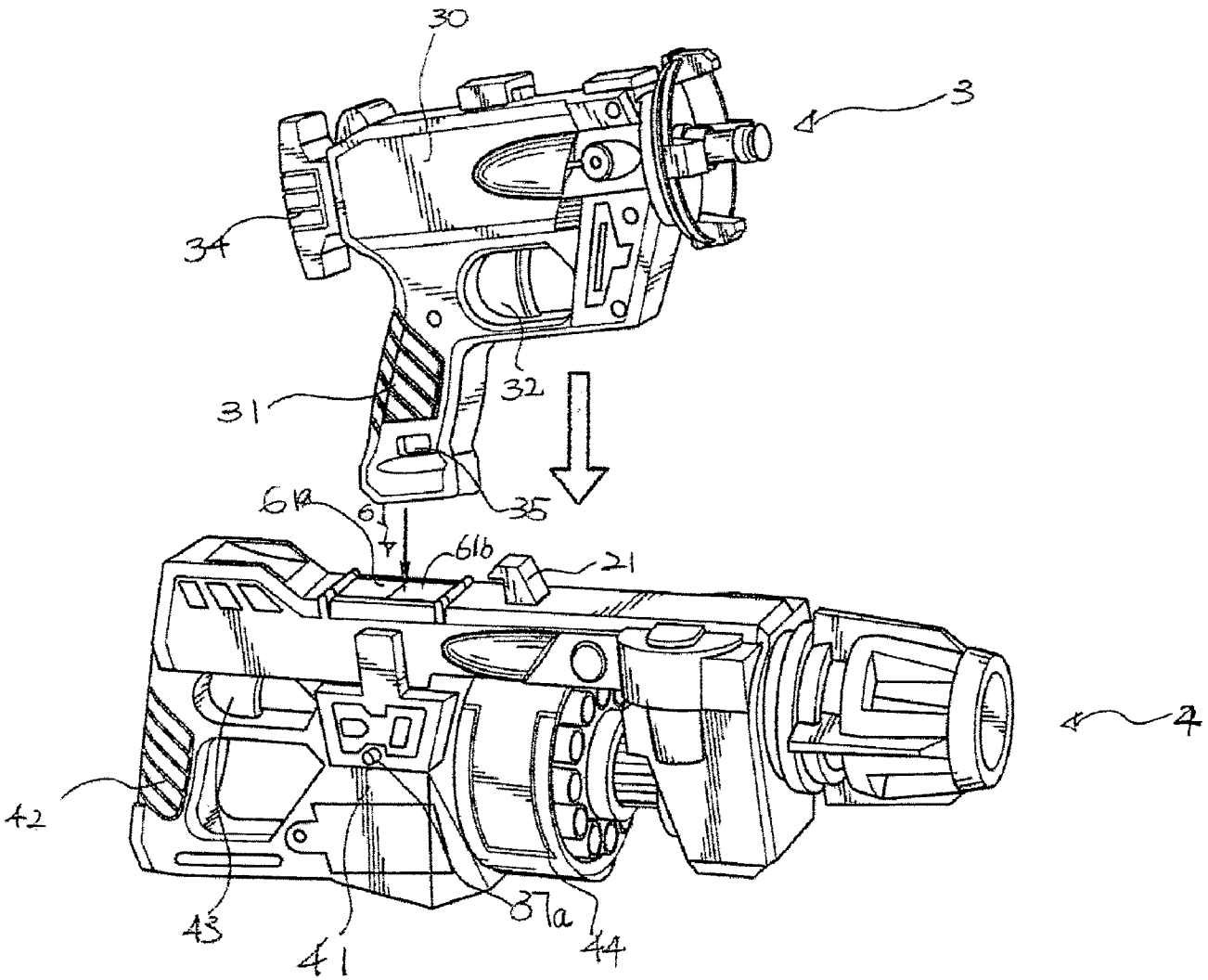
FIG. 11 is a perspective view of the upper and lower guns of FIG. 1 about to be connected.
Figure 12:
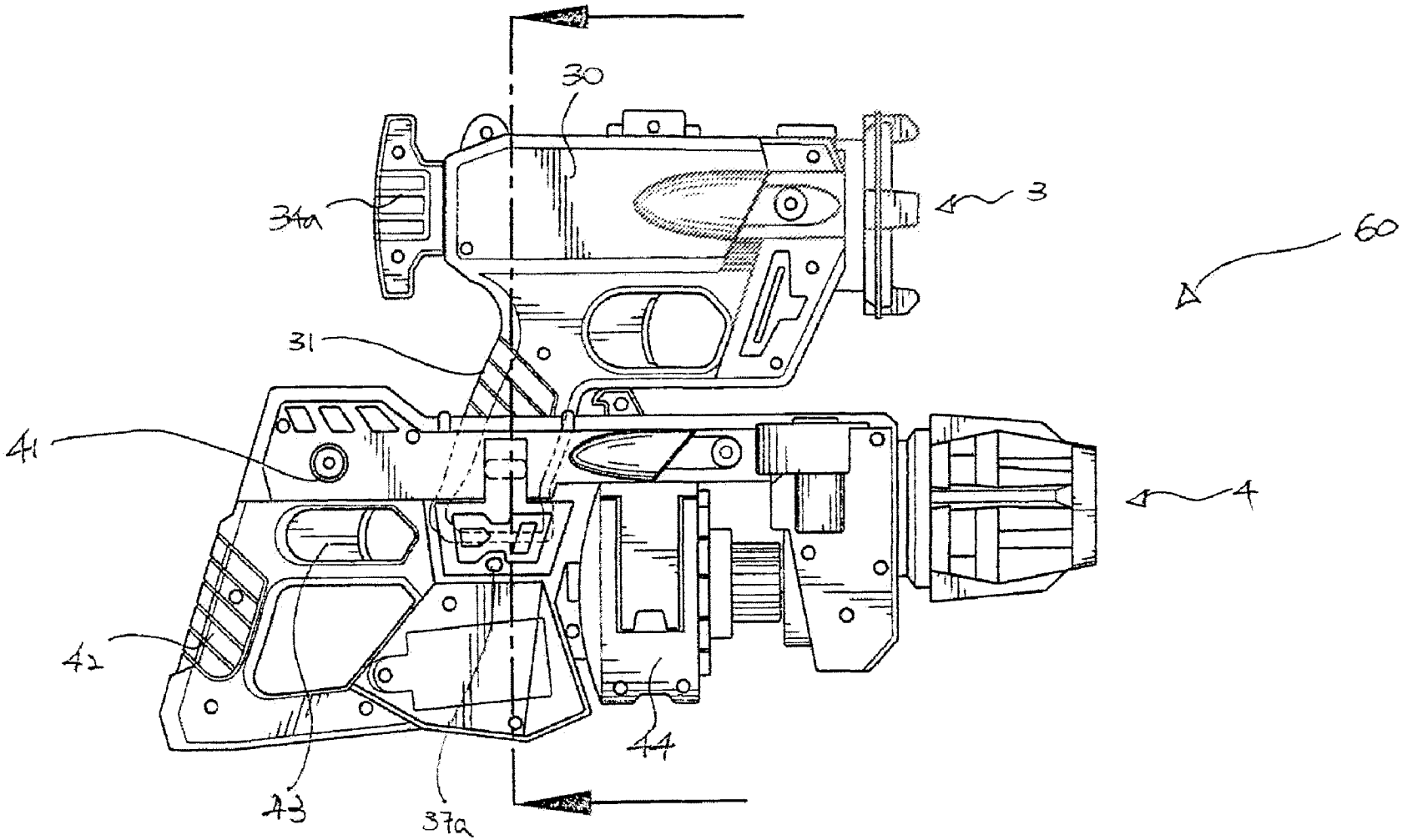
FIG. 12 is a side view of a further embodiment of a toy gun assembly in accordance with the invention including the upper and lower guns of FIG. 11.
Figure 13:
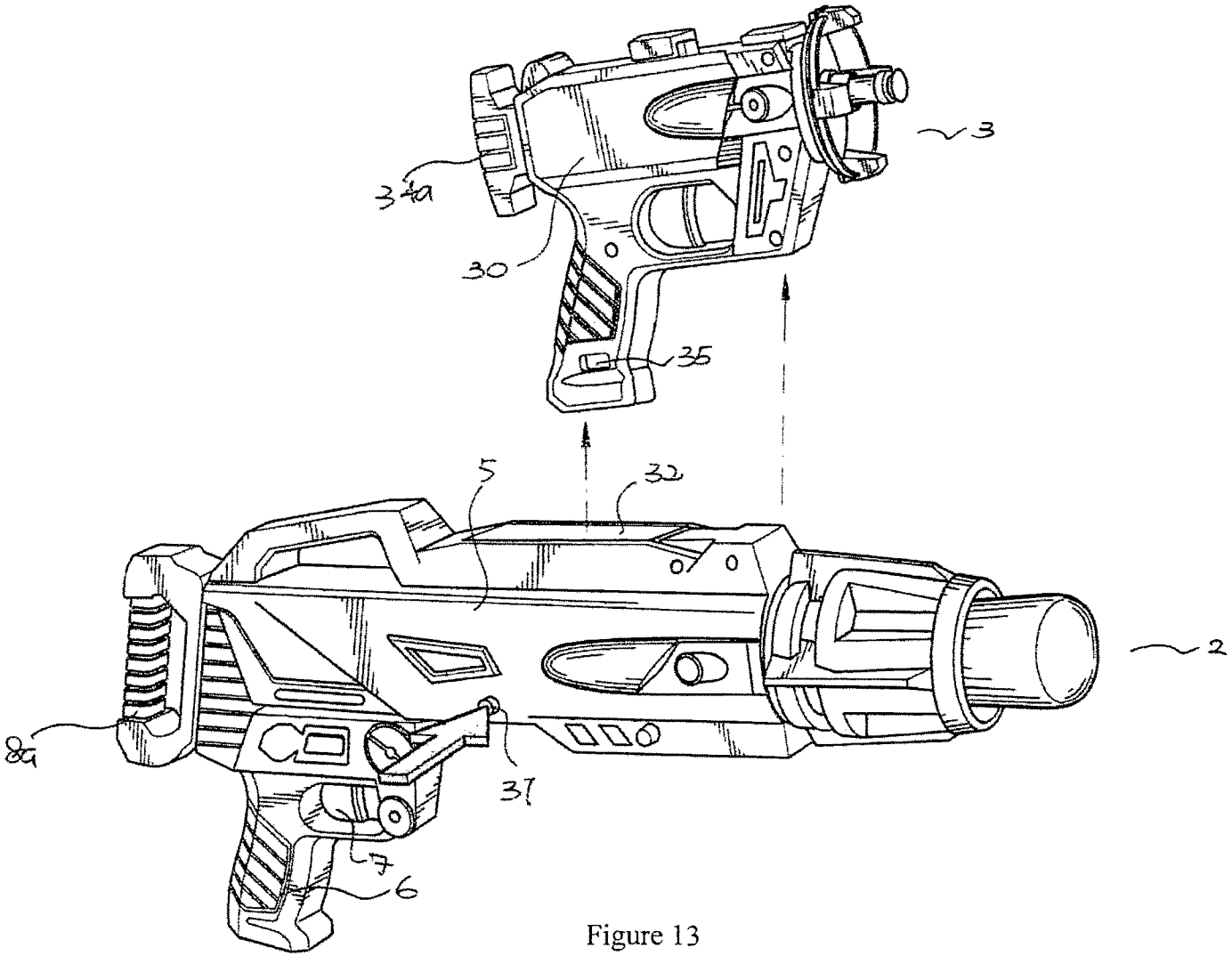
FIG. 13 is a perspective view of the upper and primary guns of FIG. 11 being detached.

Referring now to FIGS. 11 to 12, in accordance with another alternative embodiment of the present invention, the guns 3 and 4 are connectable to form a 2-in-1 gun assembly 60 by a coupler. The body 41 of the gun 4 has an opening 61 on its top which is guarded by a pair of pivotable doors 61*a*, 61*b*. The coupler has a male component 36*a* which is in the form of a hook inside the doors 61*a*, 61*b* and a female component 35 which is a recess on the handle 31 of gun 3.

To couple the guns 3, 4, the handle of gun 3 is inserted into opening 61 of gun 4. The hook 36*a* hooks onto the recess 35 in the way shown in FIGS. 10*a* to 10*c*. The hook 36*a* can be released by pressing button 37*a* on the body 41 as illustrated in FIG. 11*d*.

Figure 14:
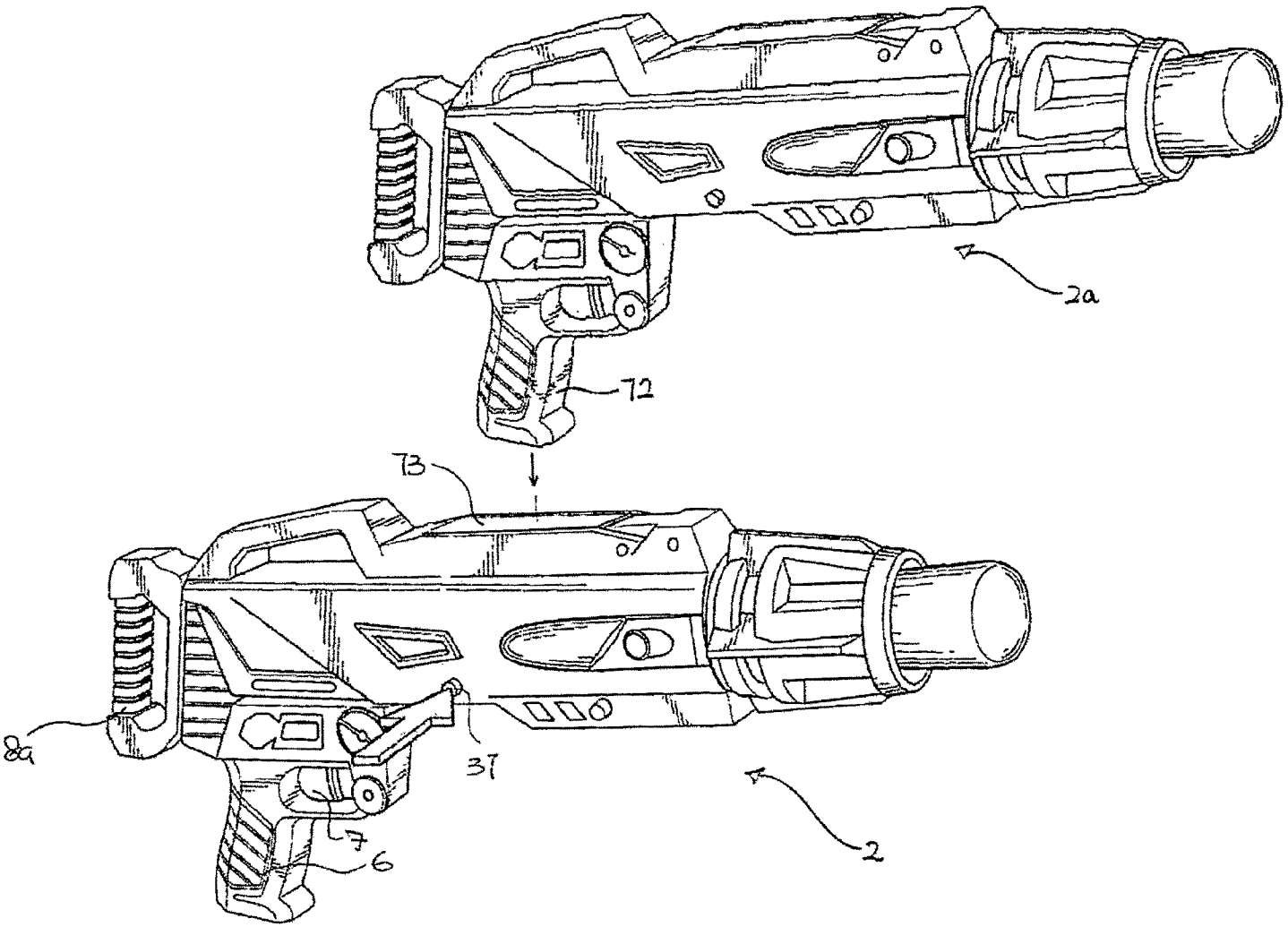
FIG. 14 is a perspective view of two primary guns of FIG. 1 about to be connected.
Figure 15:
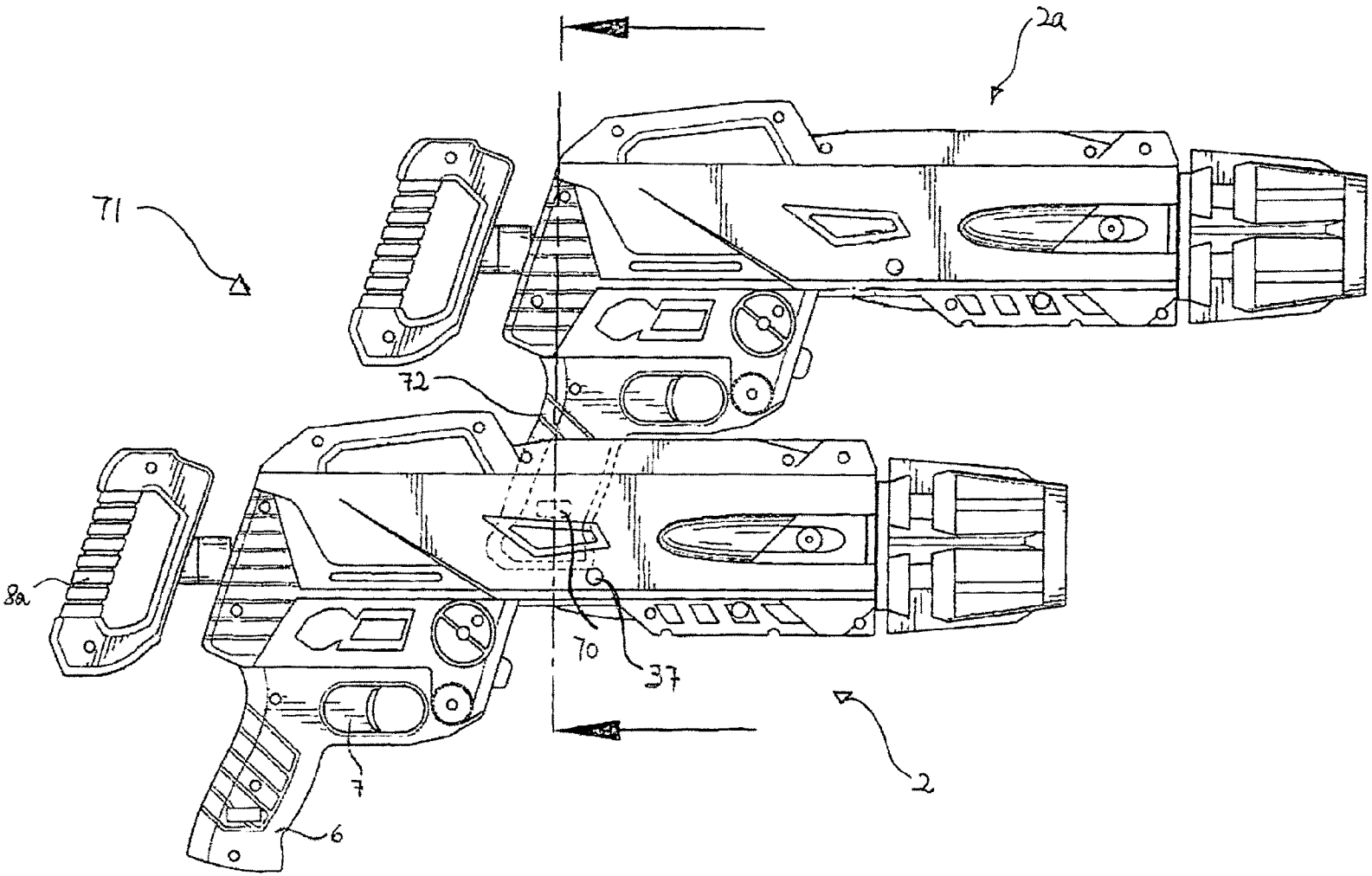
FIG. 15 is a perspective view of another embodiment of a toy gun assembly in accordance with the invention including two primary guns of FIG. 14 being connected.

With reference to FIGS. 14 to 15, a user can connect the housing of the toy gun 2 to another identical toy gun 2*a* via a connector to form a 2-in-1 toy gun assembly 71. In addition, the toy gun 2*a* can be connected to the toy gun 3 and the toy gun 2 is connectable with the toy gun 4 to form a larger, 4-in-1, toy gun assembly with more play value.

The connector includes a pair of male and female component 36, 70. The male component 36 is the hook 36 provided inside the body 5 of toy gun 2. An opening 73 on the body 5 is sized to receive a handle 72 of the toy gun 2*a*. The female component 70 is a recess provided on the handle 72 of the toy gun 2*a*. To connect the toy guns 2 and 2*a*, the handle 72 of the toy gun 2*a* is pushed through the doors 32. The recess 70 engages the hook 36 in the way as shown in FIGS. 11*a* to 11*c* thereby locking the toy gun 2*a* in place. Referring now to FIG. 11*d*, the hook 36 can be released by pressing button 37. The hook 36 is caused to bias against the biasing means (not shown) to release the recess 70.

All the toy guns 2, 2*a*, 3, 4 have respective shooting axes that lie generally horizontally, and they are inter-engageable to form a single one-piece structure with their shooting axes extending substantially co-parallel or in the same general, forward direction.

It should be appreciated that modifications and alterations obvious to those skilled in the art of toy gun design, manufacture and use, should not be considered as beyond the scope as specified in the appended claims.

For example, the specific embodiment includes three independently operable toy guns. In an alternative embodiment, there can be any number of independently operable toy guns inter-connectable in various combinations.

The invention claimed is:

1. A toy gun assembly comprising:

a plurality of toy guns, said plurality comprising a first, a second, and a third independently operable toy gun, each of said toy guns having a body, and a shooting mechanism disposed within the body, wherein each of said toy guns are variably interconnectable, and a first connector for connecting said first toy gun with said second toy gun, and a second connector for connecting said third toy gun with said first toy gun, wherein the first connector comprises a first connecting component of the first toy gun inter-engageable with a second connecting component of the second toy gun, wherein the shooting mechanisms remain independently operable when the toy guns are interconnected.

2. The toy gun assembly as claimed in claim 1, wherein the first connecting component is configured to be movable between a first position in engagement with the second connecting component and a second position out of engagement with the second connecting component, and a resilient biasing element resiliently biasing the first connecting component towards the first position to engage with the second connecting component.

3. The toy gun assembly as claims in claim 2, wherein the first connecting component is associated with a release member which is arranged, upon movement, to move the first connecting component against the action of the resilient biasing member so as to disengage from the second connecting component.

4. The toy gun assembly as claimed in claim 1, wherein the first connector comprises a latch.

5. The toy gun assembly as claimed in claim 1, further comprising a coupler, wherein the coupler comprises a first coupling component of the second toy gun inter-engageable with a second coupling component of the third toy gun, the first coupling component being the second connecting component and inter-engageable with the first connecting component for connecting the second toy gun with the first toy gun.

6. The toy gun assembly as claimed in claim 1, wherein the toy guns have respective shooting axes and are inter-engageable together with their shooting axes extending in the same direction.

7. The toy gun assembly as claimed in claim 1, wherein the shooting mechanism of at least one of the toy guns is driven by an air pump.

8. The toy gun assembly as claimed in claim 7, wherein said at least one of the toy guns comprises a projectile gun and includes a reciprocating member arranged for reciprocating motion relative to the body for charging air into the air pump.

9. The toy gun assembly as claimed in claim 1, wherein the shooting mechanism of at least one of the toy guns comprises a pair of rollers driven by an electric motor to rotate in opposite directions for ejecting a projectile passing through the rollers.

* * * * *